US009943877B2

(12) United States Patent
Zhou et al.

(10) Patent No.: US 9,943,877 B2
(45) Date of Patent: Apr. 17, 2018

(54) DISPELLING PEN

(71) Applicants: BOE TECHNOLOGY GROUP CO., LTD., Beijing (CN); HEFEI BOE OPTOELECTRONICS TECHNOLOGY CO., LTD., Hefei (CN)

(72) Inventors: Yu Zhou, Beijing (CN); Chao Qian, Beijing (CN); Lei Jin, Beijing (CN); Xuan Cheng, Beijing (CN); Yunfa Cao, Beijing (CN)

(73) Assignees: BOE TECHNOLOGY GROUP CO., LTD., Beijing (CN); HEFEI BOE OPTOELECTRONICS TECHNOLOGY CO., LTD., Hefei (CN)

( * ) Notice: Subject to any disclaimer, the term of this patent is extended or adjusted under 35 U.S.C. 154(b) by 186 days.

(21) Appl. No.: 14/820,456

(22) Filed: Aug. 6, 2015

(65) Prior Publication Data

US 2016/0129471 A1 May 12, 2016

(30) Foreign Application Priority Data

Nov. 12, 2014 (CN) ..... 2014 1 0636990

(51) Int. Cl.
*B05C 17/005* (2006.01)
*A46B 15/00* (2006.01)
(Continued)

(52) U.S. Cl.
CPC .... *B05C 17/00516* (2013.01); *A46B 15/0055* (2013.01); *B05C 17/0052* (2013.01);
(Continued)

(58) Field of Classification Search
CPC combination set(s) only.
See application file for complete search history.

(56) References Cited

U.S. PATENT DOCUMENTS 1,415,718 A * 5/1922 Cantos ..... B43K 5/00 401/232
1,598,811 A * 9/1926 Ferrin ..... B60S 3/047 111/7.1
(Continued)

FOREIGN PATENT DOCUMENTS

CN 1432639 7/2003
CN 2803732 8/2006
(Continued)

OTHER PUBLICATIONS

Chinese Office Action with English Language Translation, dated Dec. 4, 2015, Chinese Application No. 2014106369908.

*Primary Examiner* — David Walczak
(74) *Attorney, Agent, or Firm* — Womble Bond Dickinson (US) LLP

(57) ABSTRACT

A dispelling pen including a pen case and a pen head connected with the pen case, wherein at least one accommodation cavity for storing a dispelling solution is disposed in the pen case. The accommodation cavity is connected with the pen head via a pipeline. A switch control valve is disposed on the pipeline. The dispelling pen need not frequently dip in the dispelling solution, thereby avoiding fragmentation and circuit scratch due to the dispelling pen's repeated contact with the substrate while increasing convenience significantly, and increasing the security of the substrate at the time of dispelling.

10 Claims, 2 Drawing Sheets

(51) Int. Cl.
*B08B 1/00* (2006.01)
*B05C 17/10* (2006.01)

(52) U.S. Cl.
CPC ..... *B05C 17/10* (2013.01); *B08B 1/002* (2013.01); *B08B 2220/01* (2013.01)

(56) References Cited

U.S. PATENT DOCUMENTS 1,945,810 A * 2/1934 Holtz ..... E01C 23/0913 15/104.31
2,797,132 A * 6/1957 Alpert ..... A47L 17/00 137/101.11
4,304,498 A * 12/1981 George ..... E04D 13/0765 134/167 C
5,072,486 A * 12/1991 Guarascio ..... B44D 3/162 15/236.01
5,137,178 A * 8/1992 Stokes ..... B65D 35/22 222/103
5,765,725 A * 6/1998 Matt ..... B65D 35/22 222/129
6,213,664 B1 * 4/2001 Kondo ..... B43K 8/00 401/205
6,685,041 B1 * 2/2004 Geisinger ..... B65D 81/3283 215/235
7,306,130 B2 * 12/2007 Brugner ..... B05C 17/00503 215/254
7,654,415 B2 * 2/2010 van der Heijden . B05B 11/3084 222/129
2014/0119808 A1 5/2014 Korper et al.

FOREIGN PATENT DOCUMENTS

| | | |
|---|---|---|
| CN | 201190228 | 2/2009 |
| CN | 103660772 | 3/2014 |
| EP | 1056829 | 5/2004 |
| WO | WO-2011139374 | 11/2011 |

* cited by examiner

DISPELLING PEN

RELATED APPLICATIONS

The present application claims the benefit of Chinese Patent Application No. 201410636990.8, filed Nov. 12, 2014, the entire disclosure of which is incorporated herein by reference.

FIELD OF THE INVENTION

The disclosure relates to the field of display device technologies, and in particular, to a dispelling pen.

BACKGROUND OF THE INVENTION

In the liquid crystal industry, for part of liquid crystal screens, it is needed to dispel anisotropic conductive films (ACFs) and residual glues for various reasons. In the prior art, usually a multifunctional ACF and residual glue dispelling pen is used to dispel ACFs and residual glues. By a multifunctional ACF and residual glue dispelling pen, it is meant a dispelling pen applying a design of a cylindrical pen case to integrate a technique for dispelling ACFs and residual glues therein to facilitate dispelling. Currently, the multifunctional ACF and residual glue dispelling pen used in the industry is a Teflon dispelling pen, however, there are some problems as follows when using such a dispelling pen to dispel ACFs and residual glues: the operation is inconvenient, the dispelling is incomplete, it needs to dip in a dispelling solution for dispelling more than once, and thus it is easy to cause fragmentation and circuit scratch since the dispelling pen contacts the substrate frequently and repeatedly; and meanwhile, it is easy to cause the container holding the dispelling solution to dump in the process of dipping in the dispelling solution.

SUMMARY OF THE INVENTION

To overcome and avoid the above drawbacks and problems of the ACF and residual glue dispelling pen in the prior art, the disclosure provides a dispelling pen which can effectively eliminate the hidden troubles of being easy to cause fragmentation and circuit scratch when the dispelling pen dips in a dispelling solution more than once to dispel ACFs and residual glues, and improve the security at the time of dispelling.

The dispelling pen provided by the disclosure comprises a pen case and a pen head connected with the pen case, wherein at least one accommodation cavity for accommodating a dispelling solution is disposed in the pen case, the accommodation cavity is connected with the pen head via a pipeline, and a switch control valve is disposed on the pipeline.

During the operation of the dispelling pen according to an embodiment of the disclosure, first, the pen head contacts a substrate for which dispelling is to be done; second, the switch control valve is opened when it is needed to use the dispelling solution, and the dispelling solution flows from the accommodation cavity of the pen case through the pipeline to the pen head, such that the dispelling solution can sufficiently act on the pen head, and in turn dispel ACFs and residual glues rapidly via the pen head. In the entire process of dispelling, the switch control valve may be opened or closed at any time as desired, and thereby the dispelling solution acting on the pen head can be controlled conveniently, thus enhancing the convenience of the dispelling operation; and during dispelling, the pen head need not be out of contact with the substrate, thereby avoiding the problems of fragmentation and circuit scratch resulting from the pen head being in repeated contact with the substrate due to frequently dipping in the dispelling solution in the prior art, and increasing the security at the time of dispelling.

For the dispelling pen provided by embodiments of the disclosure, by disposing a dedicated accommodation cavity on the dispelling pen which is connected with a pen head and disposing a switch control valve on a connected pipeline, thus the connection of both may be controlled rapidly by controlling the switch control valve, such that the dispelling solution can enter into the pen head rapidly. As compared to the prior art, the dispelling pen according to the disclosure need not frequently dip in the dispelling solution, and hence need not be frequently out of contact with the substrate, thereby eliminating the hidden troubles of fragmentation and circuit scratch due to repeated contact with the substrate while increasing the convenience significantly, and increasing the security of the substrate at the time of dispelling.

In an embodiment of the dispelling pen according to the disclosure, on the pen head of the dispelling pen may be disposed a liquid outlet connected with the accommodation cavity via a channel for delivering the dispelling solution from the accommodation cavity to the pen head to complete the dispelling operation.

In an embodiment of the dispelling pen according to the disclosure, the dispelling pen may further comprise a brush disposed on one end of the pen case far from the pen head for the convenience of clearing away the debris after dispelling.

In an embodiment of the dispelling pen according to the disclosure, the dispelling pen may further comprise a magnifier disposed on one end of the pen case far from the pen head for the convenience of detecting the dispelling effect.

Further, the magnifier may be located between the pen case and the brush. Moreover, a screw connection may be employed between the magnifier and the pen case, the brush and the magnifier may also employ a screw connection to facilitate connection between several components.

In an embodiment of the dispelling pen according to the disclosure, the pen head may be made from for example the Teflon material, since such a material has a strength and flexibility desired by the dispelling pen simultaneously.

In an embodiment of the dispelling pen according to the disclosure, one end of the pen head far from the pen case may be a flat structure to facilitate sufficient contact with the substrate for which the dispelling is to be done, which is beneficial to effectively dispel ACFs and residual glues.

In an embodiment of the dispelling pen according to the disclosure, the number of the liquid outlets on the pen head may be disposed to be two so as to deliver different dispelling solutions. Moreover, the two liquid outlets may be disposed symmetrically on both sides of the flat structure of the pen head. Accordingly, the connecting line of the positions of two switch control valves corresponding to the two liquid outlets respectively is perpendicular to the connecting line of the positions of the two liquid outlets to facilitate the operations when in use.

In an embodiment of the dispelling pen according to the disclosure, the switch control valve may be a push switch to facilitate the operations when in use.

REFERENCE SIGNS

1 Pen case; 11 Accommodation cavity; 12 Pipeline;
2 Pen head; 21 Liquid outlet; 22 Groove;
3 Switch control valve; 31 Valve core; 32 Spring;
4 Magnifier; 5 Brush.

DETAILED DESCRIPTION OF THE INVENTION

To make the objects, technical solutions and advantages of the disclosure clearer, in the following the disclosure will be further illustrated and elaborated in detail with non-limiting embodiments as examples.

Figure 1:
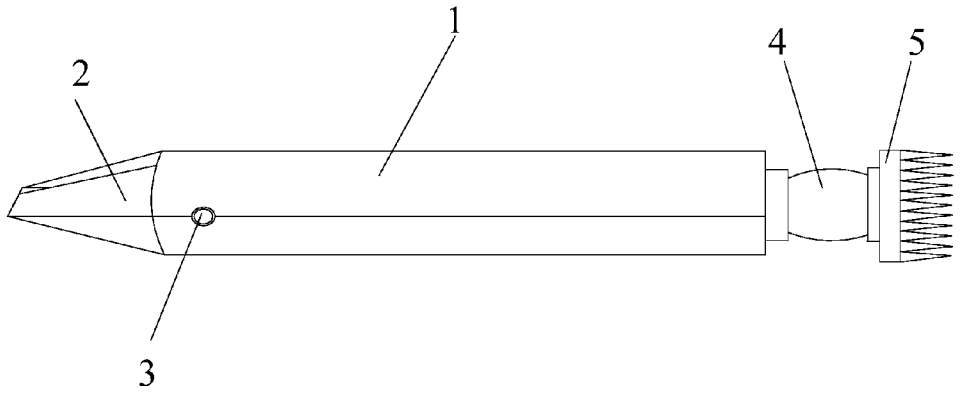
FIG. 1 is a whole structural schematic diagram of a dispelling pen according to an embodiment of the disclosure.
Figure 2:
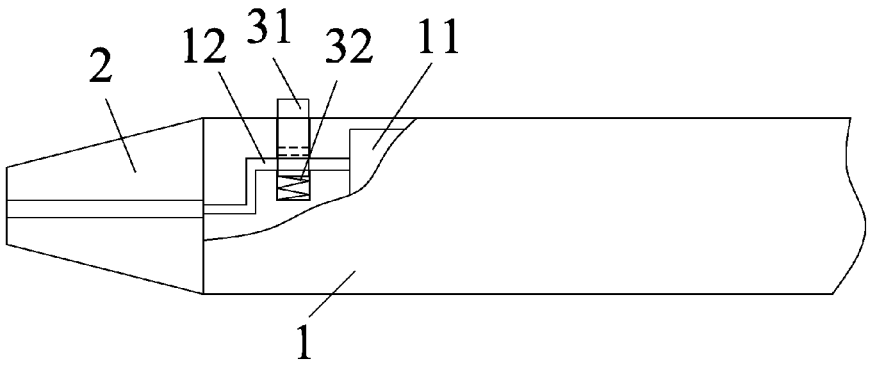
FIG. 2 is a partial sectional schematic diagram of a dispelling pen according to an embodiment of the disclosure.

FIG. 1 shows a whole structural diagram of a dispelling pen according to an embodiment of the disclosure, and FIG. 2 shows a partial sectional diagram of a dispelling pen according to an embodiment of the disclosure. As shown in FIGS. 1 and 2, the dispelling pen according to an embodiment of the disclosure comprises a pen case 1 and a pen head 2 connected with the pen case 1, wherein at least one accommodation cavity 11 for accommodating a dispelling solution is disposed in the pen case 1, each accommodation cavity 11 is connected with the pen head 2 via a pipeline 12, and a switch control valve 3 is disposed on each pipeline 12 for controlling the connection or disconnection of the accommodation cavity 12 in the pen case 1 with the pen head 2.

During the use of the dispelling pen according to an embodiment of the disclosure, first, the pen head 2 contacts a substrate for which dispelling is to be done; second, the switch control valve 3 is opened when it is needed to use the dispelling solution, and the dispelling solution flows from the accommodation cavity 11 of the pen case 1 through the pipeline 12 to the pen head 2, such that the dispelling solution can act on the pen head 2, and in turn dispel ACFs and residual glues rapidly via the pen head 2. In the entire process of dispelling, the switch control valve 3 may be opened or closed at any time as desired, and thereby the dispelling solution acting on the pen head 2 can be controlled conveniently, thus enhancing the convenience of the dispelling operation; and during dispelling, the pen head 2 need not be out of contact with the substrate, thereby avoiding the problems of fragmentation and circuit scratch resulting from the pen head 2 being in repeated contact with the substrate due to frequently dipping in the dispelling solution in the prior art, and increasing the security at the time of dispelling.

For the convenience of use, the switch control valve 3 in the above embodiment may be a push switch. That is, when the switch control valve 3 is pushed down, the pipeline 12 is connected, namely, the accommodation cavity of the pen case 1 is connected with the pen head 2; and when the switch control valve 3 is released, the pipeline 12 is disconnected, namely, the accommodation cavity of the pen case 1 is not connected with the pen head 2. As shown in FIG. 2, in particular, the pipeline 12 may be a through-hole formed within the pen case 1, and an accommodation tank (not shown in the figure) for accommodating the switch control valve 3 which crosses the through-hole is disposed on the pen case 1. The switch control valve 3 may comprise a valve core 31 and a spring 32 switch, wherein a through-hole fitting in with the pipeline 12 is disposed on the valve core 31, the valve core 31 is disposed within the accommodation tank, and the spring 32 is disposed at the bottom of the accommodation tank and its two ends touch against the valve core 31 and the bottom of the accommodation tank, respectively. When the switch control valve 3 is not pushed, the through-hole on the valve core 31 is located in the accommodation tank, and other parts of the valve core 31 are located in the pipeline 12 and block the pipeline 12, such that the pipeline 12 is disconnected; and when the switch control valve 3 is pushed down, the through-hole on the valve core 31 is located in the pipeline 12, such that two parts of the pipeline 12 located on both sides of the valve core 31 are connected. By using the above switch control valve 3, the outflow and the time of outflow of the dispelling solution can be controlled arbitrarily, which greatly facilitates the dispelling operation and significantly increases the working efficiency.

As shown in FIG. 1 and FIG. 2, for the convenience of dispelling ACFs and residual glues on the substrate, one end of the pen head 2 far from the pen case 1 may be designed to be a flat structure, such that the pen head 2 forms a structure similar to a shovel head and the one end of it far from the pen case 1 can sufficiently contact the substrate. In general, the pen head 2 may be made from the Teflon material. Since the Teflon material has a certain strength and at the same time also has a certain flexibility, the pen head 2 made from the material may not only provide an enough force that can clear away ACFs and residual glues, but also avoid causing scratch to circuit lines and the substrate.

Figure 3:
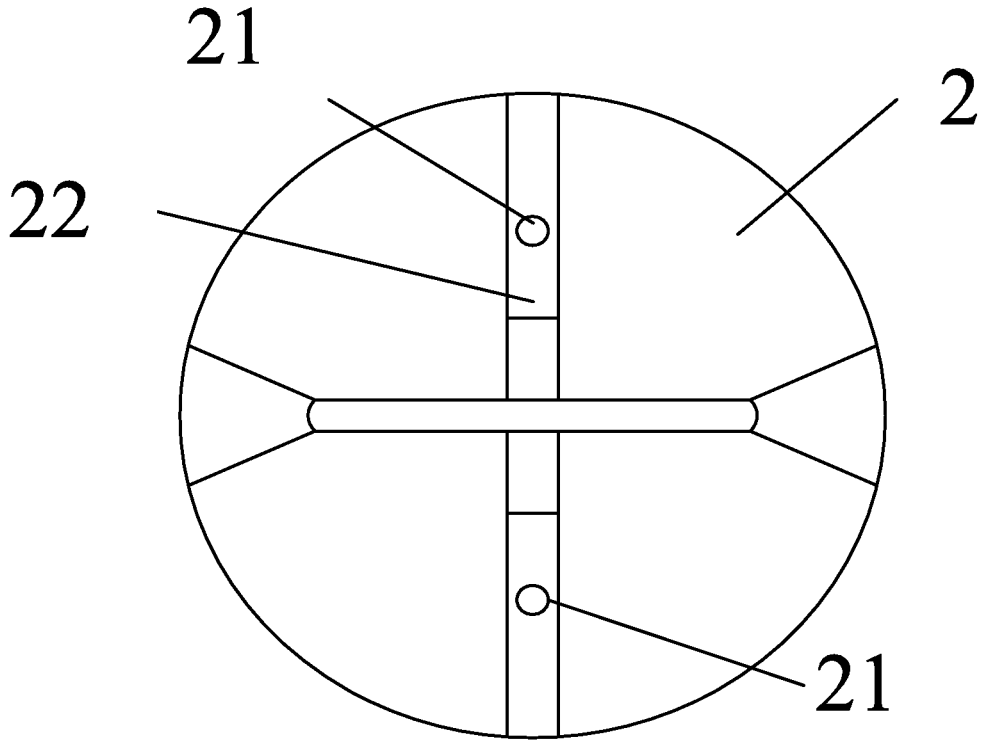
FIG. 3 is cross-sectional schematic diagram of a pen head of the dispelling pen according to an embodiment of the disclosure.

FIG. 3 shows cross-sectional schematic diagram of a pen head of the dispelling pen according to an embodiment of the disclosure. As shown in FIG. 3, on the pen head 2 may be disposed a liquid outlet 21 for being connected with the accommodation cavity 11 in the pen case 1 via the pipeline 12. As shown in FIG. 3, two liquid outlets 21 may be disposed on the pen head 1. When the pen head 2 has two liquid outlets 21, accordingly, the number of the accommodation cavities 11 of the pen case 1 connected therewith as shown in FIG. 2 should also be two. In the two accommodation cavities 11, different dispelling solutions may be loaded, e.g., common dispelling solutions alcohol and acetone, for example, alcohol is loaded in one accommodation cavity 11, and acetone is loaded in the other accommodation cavity 11; or when one kind of dispelling solution is employed, it may be loaded in the two accommodation cavities 11 simultaneously.

When the pen head 2 has two liquid outlets 21, as shown in FIG. 3, the two liquid outlets 21 are disposed symmetrically on both sides of the flat structure of the pen head 2, such that the dispelling solution(s) flowing out of the liquid outlets 21 can act on one end of the pen head 2 in operation. In addition, as shown in FIG. 3, on the pen head 2 may further be disposed a groove 22 for facilitating circulation of the dispelling solution. After the dispelling solution flows out of the liquid outlet 21, it may flow along the groove 22 onto the flat structure of the pen head 2, such that when the dispelling operation is performed for the pen head 2, the dispelling solution can flow onto the flat structure and participate in the dispelling process. When the pen head 2 has two liquid outlets 21 and the pen case 1 has two accommodation cavities 11, the number of the pipelines 12 and the switch control valves 3 is also two, respectively. At this point, the specific positions of the two switch control valves 3 may be disposed as follows: the connecting line of the positions of the two switch control valves 3 is disposed to be perpendicular to the connecting line of the positions of the two liquid outlets 21. In particular, the positions of the switch control valves 3 may be referred to FIG. 1 and FIG. 2. When such a structure is employed to perform the dispelling operation, the flat structure of the pen head 2 contacts the substrate, one liquid outlet 21 therein faces towards the substrate, the other liquid outlet 21 faces away from the substrate, and since the connecting line of the positions of the two switch control valves 3 is perpendicular to the connecting line of the positions of the two liquid outlets 21, the connecting line of the two switch control valves 3 is approximately parallel to the plane of the substrate, which is advantageous for a worker to conveniently control the switch control valves 3 by his fingers.

Further, to improve multi-functionalization of the dispelling pen and facilitate dispelling ACFs and residual glues on the substrate, as shown in FIG. 1, the dispelling pen according to an embodiment of the disclosure may further comprise a brush 5 disposed on one end of the pen case 1 far from the pen head 2. When dispelling ACFs and residual glues, the debris after dispelling may be cleared away by the brush 5, and therefore, both the dispelling operation and the cleanup operation may be done by the dispelling pen, which increase the working efficiency.

Further, to facilitate detecting the effect after dispelling by a worker, as shown in FIG. 1, the dispelling pen according to an embodiment of the disclosure may further comprise a magnifier 4 disposed on one end of the pen case 1 far from the pen head 2. During the operation of using the dispelling pen for dispelling, detection may be performed by the magnifier 4 at any time, and thus tiny residues can be detected, guaranteeing the dispelling effect at the time of dispelling. The magnifier 4 as shown in FIG. 1 may be used in combination with the brush 5. When in use, first, dispelling of ACFs and residual glues is done via the pen head 2, afterwards, the dispelled dirt is cleaned via the brush 5, and the effect of dispelling ACFs and residual glues on the substrate is detected using the magnifier 4. At the position where residual glues are found, further dispelling is done via the pen head 2 again, thereby guaranteeing the thoroughness of the dispelling and increasing the effect and efficiency of the dispelling. Thus, by one kind of tool, the dispelling pen, all the functional requirements in the entire dispelling process are satisfied, which makes the dispelling operation more convenient and efficient, and avoids a tedious and inefficient situation resulting from using multiple kinds of tools in the prior art.

In addition, as shown in FIG. 1, the magnifier 4 and the pen case 1 may be connected by way of screws, and there may also be a screw connection between the brush 5 and the magnifier 4. In a particular connection process, as shown in FIG. 1, the magnifier 4 may be located between the pen case 1 and the brush 5. The pen head 2, the pen case 1, the magnifier 4 and the brush 5 take the form of a line after being connected as a whole, thereby facilitating the use, and avoiding affection of the convenience of use of the dispelling pen by the added magnifier 4 and brush 5.

Obviously, various changes and variations may be made to the disclosure by those skilled in the art without departing from the spirit and scope of the disclosure. Thus, the disclosure is intended to encompass these changes and variations, provided that these changes and variations of the disclosure pertain to the scope of the claims of the disclosure and their equivalents.

The invention claimed is:

1. A dispelling pen comprising a pen case and a pen head connected with the pen case, wherein at least two accommodation cavities for storing a dispelling solution are disposed in the pen case, the at least two accommodation cavities are respectively connected with at least two liquid outlets disposed on the pen head via different pipelines each provided with a switch control valve, wherein on the pen head is disposed at least two grooves connected respectively with the at least two liquid outlets.

2. The dispelling pen as claimed in claim 1, further comprising a brush disposed on one end of the pen case far from the pen head.

3. The dispelling pen as claimed in claim 2, further comprising a magnifier disposed on one end of the pen case far from the pen head.

4. The dispelling pen as claimed in claim 3, wherein the magnifier is located between the pen case and the brush.

5. The dispelling pen as claimed in claim 4, wherein there is a screw connection between the magnifier and the pen case, and there is a screw connection between the brush and the magnifier.

6. The dispelling pen as claimed in claim 1, wherein the pen head is made from a Teflon material.

7. The dispelling pen as claimed in claim 1, wherein one end of the pen head far from the pen case is a flat structure.

8. The dispelling pen as claimed in claim 7, wherein the pen head comprises two liquid outlets, and the two liquid outlets are disposed symmetrically on both sides of the flat structure of the pen head.

9. The dispelling pen as claimed in claim 8, wherein the connecting line of the positions of the two liquid outlets is perpendicular to a connecting line of positions of the two switch control valves corresponding to the two liquid outlets respectively.

10. The dispelling pen as claimed in claim 1, wherein each of the switch control valves is a push switch.

* * * * *